US010278276B2

(12) United States Patent
Elizondo-Decanini

(10) Patent No.: US 10,278,276 B2
(45) Date of Patent: Apr. 30, 2019

(54) SHORT PULSE NEUTRON GENERATOR

(71) Applicant: National Technology & Engineering Solutions of Sandia, LLC, Albuquerque, NM (US)

(72) Inventor: Juan M. Elizondo-Decanini, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 328 days.

(21) Appl. No.: 15/190,035

(22) Filed: Jun. 22, 2016

(65) Prior Publication Data

US 2016/0302297 A1 Oct. 13, 2016

Related U.S. Application Data

(63) Continuation of application No. 14/016,609, filed on Sep. 3, 2013, now Pat. No. 9,408,286.

(51) Int. Cl.

| | |
|---|---|
| ***H05H 3/06*** | (2006.01) |
| ***H05H 1/12*** | (2006.01) |
| ***H05H 5/03*** | (2006.01) |
| ***H05H 5/04*** | (2006.01) |

(52) U.S. Cl.

CPC ..... *H05H 3/06* (2013.01); *H05H 1/12* (2013.01); *H05H 5/03* (2013.01); *H05H 5/047* (2013.01)

(58) Field of Classification Search

CPC ... G21B 1/00; G21B 1/11; G21B 1/15; G21B 1/17; G21B 1/19; G21B 3/006

See application file for complete search history.

(56) References Cited

U.S. PATENT DOCUMENTS

| | | | |
|---|---|---|---|
| 4,223,279 | A | 9/1980 | Bradford, Jr. et al. |
| 4,298,804 | A | 11/1981 | Colditz |
| 9,230,772 | B2 | 1/2016 | Zhou et al. |
| 2005/0220244 | A1 | 10/2005 | Leung |
| 2010/0032580 | A1 | 2/2010 | Caporaso et al. |
| 2012/0146553 | A1 | 6/2012 | Joshkin et al. |

(Continued)

OTHER PUBLICATIONS

Rebersek, et al., "Blumlein Configuration for High-Repetition-Rate Pulse Generation of Variable Duration and Polarity Using Synchronized Switch Control", IEEE Transactions on Biomedical Engineering, vol. 56, No. 11, Nov. 2009, pp. 2642-2648.

*Primary Examiner* — Marshall P O'Connor

(74) *Attorney, Agent, or Firm* — Samantha Updegraff

(57) ABSTRACT

Short pulse neutron generators are described herein. In a general embodiment, the short pulse neutron generator includes a Blumlein structure. The Blumlein structure includes a first conductive plate, a second conductive plate, a third conductive plate, at least one of an inductor or a resistor, a switch, and a dielectric material. The first conductive plate is positioned relative to the second conductive plate such that a gap separates these plates. A vacuum chamber is positioned in the gap, and an ion source is positioned to emit ions in the vacuum chamber. The third conductive plate is electrically grounded, and the switch is operable to electrically connect and disconnect the second conductive plate and the third conductive plate. The at least one of the resistor or the inductor is coupled to the first conductive plate and the second conductive plate.

8 Claims, 7 Drawing Sheets

(56) References Cited

U.S. PATENT DOCUMENTS

| | | | | |
|---|---|---|---|---|
| 2012/0213319 | A1 | 8/2012 | Kwan et al. | |
| 2013/0048847 | A1 | 2/2013 | Gilchrist et al. | |
| 2013/0170592 | A1* | 7/2013 | Zhou ..... | H01J 27/02 376/114 |
| 2013/0180780 | A1 | 7/2013 | Chirovsky et al. | |

* cited by examiner

SHORT PULSE NEUTRON GENERATOR

CROSS-REFERENCE TO RELATED APPLICATION

This application is a continuation of prior U.S. application Ser. No. 14/016,609, filed Sep. 3, 2013, and claims the benefit of the same. The above application is incorporated herein by reference in its entirety.

STATEMENT OF GOVERNMENTAL INTEREST

This invention was developed under Contract DE-AC04-94AL85000 between Sandia Corporation and the U.S. Department of Energy. The U.S. Government has certain rights in this invention.

BACKGROUND

The utility of neutron generators in various endeavors is well known. Neutron generators are commonly used in a diverse set of applications, including oil well logging, material detection, imaging, treatment/monitoring of medical conditions, etc. Conventional high fluence, non-active neutron generator technology is mostly based upon vacuum accelerator or radio frequency (RF) techniques. In an exemplary conventional neutron generator, a relatively high voltage is used to accelerate deuterium (D) ions. The accelerated ions impact a metal target loaded with tritium (T) gas, causing a deuterium-tritium (DT) fusion reaction that produces neutrons. A device such as the neutron generator described above appeared in the literature in the early 1960s, and the design continues to evolve with variations on the accelerator type, power supply driver type, size, and output.

Relatively recently, short pulse neutron generators have been introduced that generate a pulse of approximately $10^{12}$ neutrons over a length of time on the order of 25 to 50 nanoseconds. Conventional designs for short pulse neutron generators include the use of plasma focus devices (PFD), which may take a relatively long time to recharge (e.g., twenty minutes to an hour).

SUMMARY

The following is a brief summary of subject matter that is described in greater detail herein. This summary is not intended to be limiting as to the scope of the claims.

Described herein are various technologies pertaining to neutron generators. With more particularity, described herein are various technologies pertaining to short pulse neutron generators. In an exemplary embodiment, a short pulse neutron generator can comprise a Blumlein configuration. The Blumlein configuration includes a first conductive plate that is coupled to a first voltage source that can output a relatively high voltage (e.g., 50 kV-50 MV). The first conductive plate may also be referred to as a discharge plate.

The Blumlein configuration additionally includes a second conductive plate that is at least partially coplanar with the first conductive plate. The second conductive plate can be referred to as an initiation plate. At least one of a resistor or an inductor can be coupled to the first conductive plate and the second conductive plate, wherein the at least one of the resistor or inductor has a relatively high impedance (e.g., 10 MΩ). In another exemplary embodiment, the resistor or inductor can be of a value such that re-charging of the second plate (e.g., by way of the first plate) can be accomplished in a fraction of a second, such that repetition rates between approximately one hertz one kilo-hertz are possible. The first conductive plate and the second conductive plate are positioned relative to one another such that a first gap is formed therebetween.

The Blumlein configuration further includes a third conductive plate that is electrically grounded. The third conductive plate can be arranged in parallel with the first conductive plate and the second conductive plate, and can be separated from at least the first conductive plate by a dielectric material. A switch can be operable to electrically connect the second conductive plate with the third conductive plate (and thus to ground), and disconnect the second conductive plate from the third conductive plate.

A vacuum chamber is positioned in the first gap between the first conductive plate and the second conductive plate. The vacuum chamber includes a first electrode that has a target surface loaded with deuterium or tritium, wherein the first electrode is electrically coupled to the first conductive plate. The vacuum chamber also includes a second electrode that is electrically coupled to the second conductive plate, wherein the second electrode comprises a face that opposes the target surface of the first electrode, the face and the target surface separated by a second gap (e.g., an accelerating gap). The face of the second electrode forms a cavity, such that the face of the second electrode is between the target surface and the cavity. In an exemplary embodiment, the face may comprise a plurality of apertures extending therethrough.

An ion generator (ion source) can be positioned relative to the cavity such that the cavity is populated by ions generated by the ion generator. A second voltage source is coupled to the ion generator, which can cause the ion generator to output, for instance, deuterium ions.

In operation, the first voltage source outputs a relatively high voltage, thereby charging the first conductive plate and the second conductive plate (e.g., the first conductive plate and the second conductive plate have substantially equivalent voltages). Specifically, the relatively high voltage applied to the first conductive plate can effectively cause a short circuit to form between the first conductive plate and the second conductive plate, such that both conductive plates become equivalently charged. The ion generator is caused to populate the cavity in the vacuum chamber with a plurality of ions. Because the first conductive plate and the second conductive plate (and thus the first electrode and the second electrode) have an equivalent voltage, the ions generated by the ion source remain relatively stationary in the cavity (e.g., such ions are attracted to neither the first electrode nor the second electrode). The first voltage source may then cease to provide the relatively high voltage.

The switch that couples the second conductive plate with the third conductive plate can thereafter be closed, resulting in a relatively rapid voltage drop at the second electrode, while the voltage at the first electrode remains relatively high. For a relatively small amount of time (e.g., 1 nanosecond-200 nanoseconds), the first conductive plate (and thus the first electrode) retains the relatively high voltage, attracting ions in the cavity formed by the face of the second electrode (e.g., designed to let some ions escape) to the target surface of the first electrode. Ions that escape the cavity impact the target surface of the first electrode, producing a relatively short pulse of neutrons. The first conductive plate then discharges by way of the ions accelerated over the accelerating gap. Thereafter, the switch can be opened, and the first voltage source can be configured to output the relatively high voltage, again charging both the first and the second conductive plates (and thus the first electrode and the second electrode), and the ion source can be configured to populate the cavity in the vacuum chamber with more ions. The exemplary short pulse neutron generator configured in the manner above can generate several short neutron pulses in a second, compared to the several minutes or hours required by conventional short pulse neutron generators.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION

Figure 1:
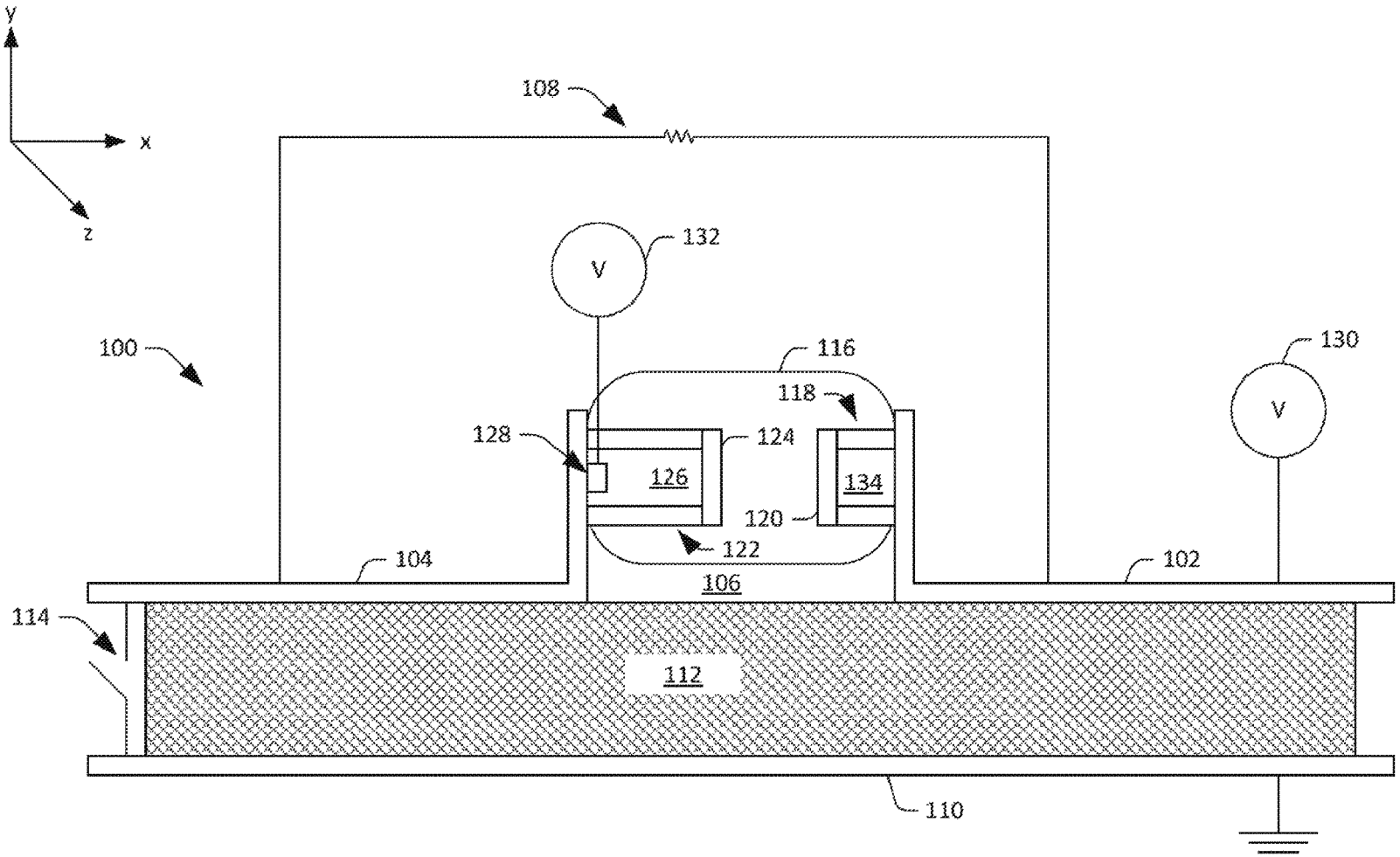
FIG. 1 is a cross-sectional view of an exemplary short pulse neutron generator.

Various technologies pertaining to short pulse neutron generators are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details. In other instances, well-known structures and devices are shown in block diagram form in order to facilitate describing one or more aspects.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Described herein are various technologies pertaining to short pulse neutron generators. An exemplary short pulse neutron generator described herein can output a neutron pulse having a pulse length of between one nanosecond and 100 nanoseconds. Furthermore, an exemplary short pulse neutron generator described herein can generate neutron pulses relatively rapidly, such as with a frequency of between 1 Hz and 2440 Hz (or higher). The exemplary short pulse neutron generators described herein have a variety of applications, including radiography and material identification. As a length (in time) of the pulse of neutrons generated by the exemplary short pulse neutron generator is relatively short, harmful effects associated with conventional neutron generators may be avoided.

With reference now to FIG. 1, a cross-sectional view of an exemplary short pulse neutron generator 100 is illustrated. The neutron generator 100 comprises a Blumlein structure. The Blumlein structure includes a first conductive plate 102 and a second conductive plate 104. At least a portion of the first conductive plate 102 and the second conductive plate 104 can be coplanar with one another, with optional orthogonal extensions therefrom. The first conductive plate 104 and the second conductive plate 102 are positioned such that a gap 106 separates the first conductive plate 102 from the second conductive plate 104. At least one of a resistor or inductor 108 with relatively high impedance (e.g., 5 MΩ-20 MΩ) can be placed between the first conductive plate 102 and the second conductive plate 104. Recharge rate of the second conductive plate 104 can be based upon the value of the impedance of the at least one of the resistor or inductor 108.

The Blumlein structure further includes a third conductive plate 110 that is electrically grounded. The third conductive plate 110 may be positioned in parallel with the first conductive plate 102 and the second conductive plate 104, wherein a dielectric material 112 separates the first conductive plate 102 from the third conductive plate 110, and further optionally separates the second conductive plate 104 from the third conductive plate 110. The Blumlein structure can further comprise a switch 114 that is configured to connect and disconnect the second conductive plate 104 to and from the third conductive plate 110. In an exemplary embodiment, the switch 114 can be a spark gap.

The first conductive plate 102, the second conductive plate 104, and the third conductive plate 110 can be composed of any suitable conductive material, including copper, steel, titanium, or the like. The dielectric material 112 may also be any suitable dielectric material, including porcelain, glass, a plastic, etc.

The neutron generator 100 additionally includes a vacuum chamber 116 positioned in the gap 106 between the first conductive plate 102 and the second conductive plate 104. A first electrode 118 is included in the vacuum chamber 116 and extends from the first conductive plate 102. The first electrode 118 includes a target surface 120 that can be loaded with tritium and/or deuterium. A second electrode 122 is also included in the vacuum chamber 116 and extends from the second conductive plate 104. The second electrode 122 comprises a face 124, wherein the face forms a cavity 126, the face 124 positioned between the cavity 126 and the target surface 120. The face 124 of the second electrode 122 opposes the target surface 120 of the first electrode, the face 124 of the second electrode 122 separated from the target surface 120 of the first electrode 118 by an accelerating gap. In an exemplary embodiment, the accelerating gap can be between 0.1 centimeter and 2 centimeters. Further, the face 124 can comprise a plurality of apertures extending therethrough.

An ion generator 128 can be positioned to emit ions into the cavity 126. Accordingly, as shown, the ion generator 128 can be positioned in the cavity 126. In another exemplary embodiment, the ion generator 128 can be external to the vacuum chamber 116, but can be configured to emit ions into the cavity 126.

A first voltage source 130, which is configured to output a relatively high voltage (e.g., between 50 kV and 50 MV), is electrically connected to the first conductive plate 102. A second voltage source 132 is electrically connected to the ion generator 128 and is configured to drive the ion generator 128, thereby causing the ion generator 128 to generate ions.

Operation of the short pulse neutron generator is now described. The switch 114 is opened, disconnecting the first voltage source 130, the first conductive plate 102, the at least one of the resistor or the inductor 108, and the second conductive plate 104 from the third conductive plate 110 (and thus from ground). The first voltage source 130 outputs a relatively high voltage, creating a short circuit between the first conductive plate 102 and the second conductive plate 104, resulting in the first conductive plate 102 and the second conductive plate 104 retaining an electrical charge (e.g., having an equivalent voltage). The second voltage source 132 is then configured to drive the ion generator 128, causing the ion generator 128 to populate the cavity 126 with ions. As the voltage of the first conductive plate 102 (and thus the first electrode 118) and the second conductive plate 104 (and thus the second electrode 122) are equivalent, the ions in the cavity 126 are not attracted to either of the first electrode 118 or the second electrode 122. Population of the cavity 126 with ions while voltage of the first electrode 118 and the second electrode 122 are approximately equivalent can be referred to as "pre-filling" the cavity 126.

Once the cavity 126 is sufficiently populated with ions, the first voltage source 130 ceases to output the relatively high voltage, and the switch 114 is closed. Responsive to the switch closing, voltage of the second conductive plate 104 (and thus the second electrode 122) rapidly drops, while the voltage of the first conductive plate 102 (and thus the first electrode 118) remains relatively high. The ions in the cavity 126 are thus attracted to the first electrode 118, and ions proximate to the face 124 exit the cavity 126 by way of the apertures and are accelerated over the accelerating gap towards the target surface 120 of the first electrode 118. Such ions impact the tritium or deuterium in the target surface 120, forming neutrons that are isotropically emitted from the vacuum chamber 116.

The first conductive plate 102 discharges via the ions accelerated in the gap between the first electrode 118 and the second electrode 122, wherein the current of accelerated ions can be several milli-amperes (mA) to thousands of amperes (kA), as determined by a production strength of the ion generator 128, size of the cavity 126, and ultimately a number of neutrons desired by an operator of the neutron generator 100. The discharge time duration is controlled by the dimensions of the first conductive plate 102, the second conductive plate 104, and the third conductive plate 110 in an axis perpendicular to the first electrode 118 and the second electrode 122 (e.g., along the x-axis). The current magnitude is controlled by the dimensions of the first conductive plate 102, the second conductive plate 104, and the third conductive plate 110 in an axis parallel to the first electrode 118 and the second electrode 122 (e.g., along the z-axis).

Responsive to the first conductive plate 102 discharging, the switch 114 can be opened and the first voltage source 130 can be configured to output the relatively high voltage, thereby charging the first conductive plate 102 and the second conductive plate 104. This process can repeat relatively rapidly, such as on the order of 60 Hz, 120 Hz, 240 Hz, or 2400 Hz. As indicated above, the switch 114 may be a spark gap. In another exemplary embodiment, the switch 114 can be or include a Silicon-controlled rectifier (SCR), a high-power MOS-FET-based solid state switching arrangement, etc. Thus, another voltage source can drive, or trigger, the spark gap or solid state-based switch, causing a short to occur between the second conductive plate 104 and the third conductive plate 110, for example, when the spark gap is fired.

It can be ascertained that dimensions of portions of the neutron generator 100 can be selected based upon desired duration of a neutron pulse, a number of neutrons desirably generated by the neutron generator 100, etc. For instance, as length of the first conductive plate 102 and/or the second conductive plate 104 increases, a duration of a voltage pulse at the first electrode 118 increases. Further, distance between the target surface 120 and the face 124 can be selected based upon a desired discharge rate of the first conductive plate 102. Moreover, a number of ion generators, position of ion generators, size of the cavity 126, size of the target surface 120, etc. can be selected based upon a volume of neutrons desirably generated.

Other exemplary embodiments are now described. While the target surface 120 of the first electrode 118 and the face 124 of the second electrode 122 are shown as being planar in nature, it is to be understood that the target surface 120 and/or the face 124 may have a three-dimensional curved profile, such as a three-dimensional elliptical surface, a surface with a Rogowsky profile, or a surface with a Chen profile. In another example, while the face 124 has been described as comprising apertures extending therethrough, it is to be understood that the face 124 can be designed with a curved profile or "L" shape in such a manner that ions can escape the cavity 126. For instance, the cavity 126 may be only partially enclosed.

In another exemplary embodiment, the first voltage source 130 can be an AC voltage source that continuously provides voltage to the first conductive plate 102. In such an embodiment, the second voltage source 132 is timed relative to the first voltage source to populate the cavity 126 when the first conductive plate 102 is nearing completion of discharge and beginning to re-charge. The switch 114 is timed with a frequency that corresponds to the frequency of the first voltage source 130. In still yet another exemplary embodiment, the target surface 120 can form a second cavity 134, and a second ion generator (not shown) can be positioned to populate the second cavity 134 with ions. The face 124 of the second electrode can be loaded with deuterium and/or tritium, and the relative polarities of the first electrode 118 and second electrode 122 can alternate. Accordingly, ions are accelerated in both directions in the accelerating gap, depending upon the relative polarities of the first electrode 118 and the second electrode 122. Further, the discharge chamber 116 can optionally include polarized rods that are positioned relative to the ion generator 128 and the face 124 of the second electrode 122 to prevent secondary electron emissions. For instance, polarized rods can extend along the length of the cavity 126 (e.g., along the x-axis), directing the ions towards the face 124 and the apertures therethrough.

The ion source 128 can be any suitable ion source. For instance, the ion source 128 can be a relatively high current surface discharge ion source that is capable of de-sorbing loaded deuterium and ionizing such deuterium at approximately the same time. With more specificity, the ion source can comprise a thin film of titanium, scandium, or other suitable metal that includes deuterium loaded thereon. Furthermore, the ion source 128 may comprise two opposing electrodes, an array of series electrodes, or an array of parallel electrodes. An exemplary ion source can be composed of two opposing electrodes made of tritium, erbium, or scandium, loaded with deuterium, such that deuterium gas is released as the temperature rises, which occurs as current flows. That is, ions are formed by the electron flow from the opposite electrode.

Figure 2:
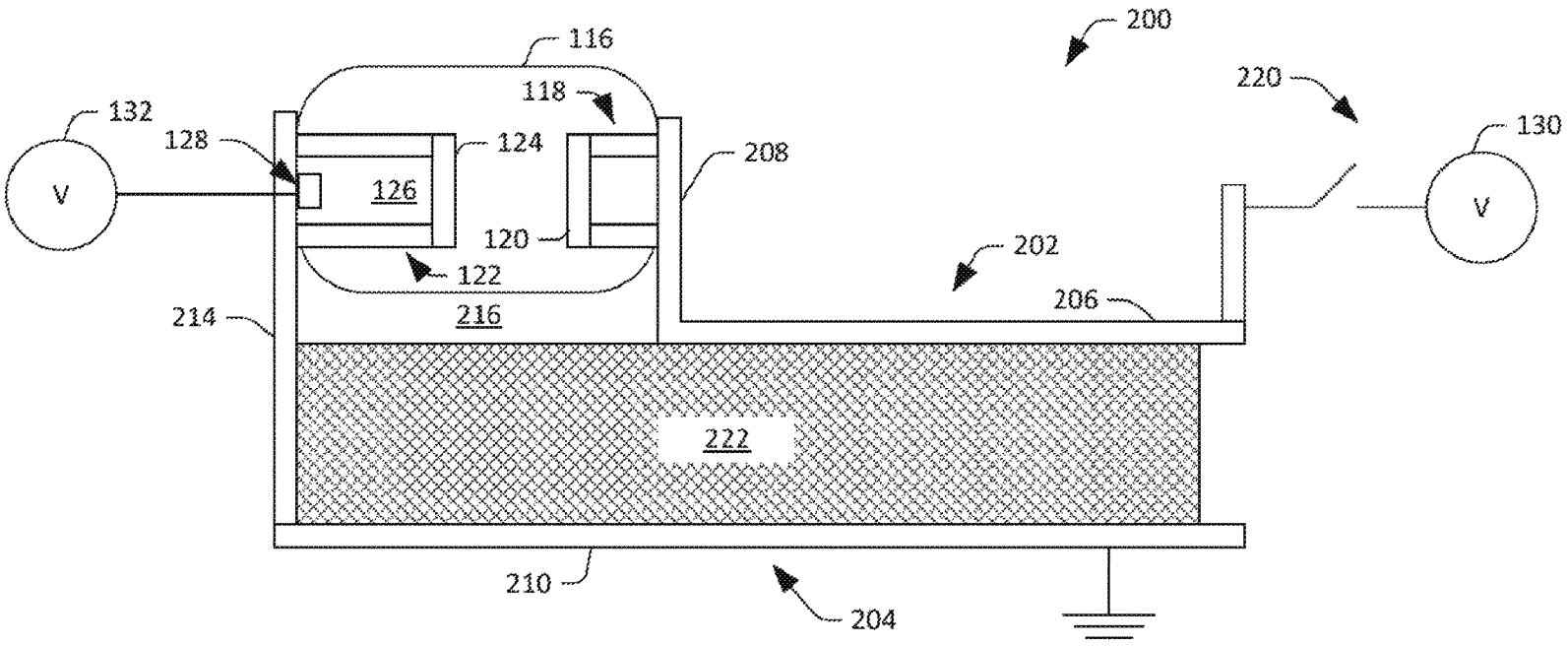
FIG. 2 is a cross-sectional view of another exemplary short pulse neutron generator.

Now referring to FIG. 2, a cross-sectional view of another exemplary short pulse neutron generator 200 is illustrated. The exemplary neutron generator 200 comprises a first conductive plate 202 and a second conductive plate 204. The first conductive plate 202 includes a first portion 206 that extends laterally in a first plane and a second portion 208 that extends orthogonally from the first portion 206 at an end of the first portion 206. The second conductive plate 204 comprises a first portion 210 that extends laterally in parallel with the first portion 206 of the first conductive plate 202 and beyond the second portion 208 of the first conductive plate 202. The second conductive plate 204 also includes a second portion 214 that extends orthogonally from the first portion 210 of the second conductive plate 204 at an end thereof, and in parallel with the second portion 208 of the first conductive plate 202. A gap 216 is formed between the second portion 208 of the first conductive plate 202 and the second portion 214 of the second conductive plate 204.

The vacuum chamber 116 can be positioned in the gap 216 and can comprise the first electrode 118 having the target surface 120, the second electrode 122 having the face 124 that forms the cavity 126, and the ion source 128, as described above.

A switch 220, such as a spark gap, electrically connects and disconnects the first voltage source 130 to and from the first conductive plate 202. A dielectric material 222 is positioned in a gap between the first portion 206 of the first conductive plate 202 and the first portion 210 of the second conductive plate 204.

Operation of the exemplary neutron pulse generator 200 is now described. The switch 220 can be opened, such that both the first conductive plate 202 and the second conductive plate 204 are uncharged. The second voltage source 132 drives the ion generator 128, causing the ion generator 128 to populate the cavity 126 with ions. When the cavity 126 includes a sufficient number of ions, the switch 220 is closed, causing the first conductive plate 202 to be charged for a relatively short amount of time. Ions in the pre-filled cavity 126 can escape, for example, through apertures of the face 124 and impact tritium or deuterium loaded into the target surface 120 of the second electrode 118. The switch 220 may then be opened, causing the first conductive plate 202 to discharge by way of the ions accelerated from the second electrode 118 to the first electrode 122 in the accelerating gap.

Figure 3:
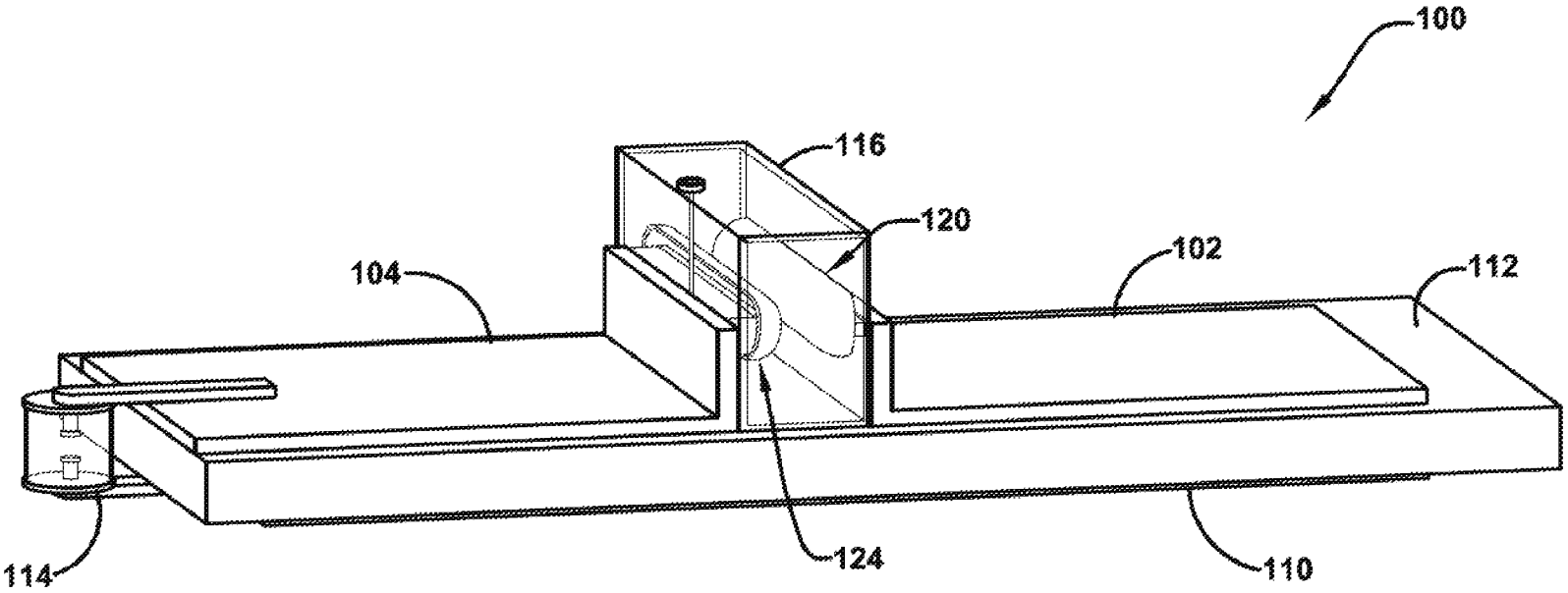
FIG. 3 is an isometric view of an exemplary short pulse neutron generator.
Figure 4:
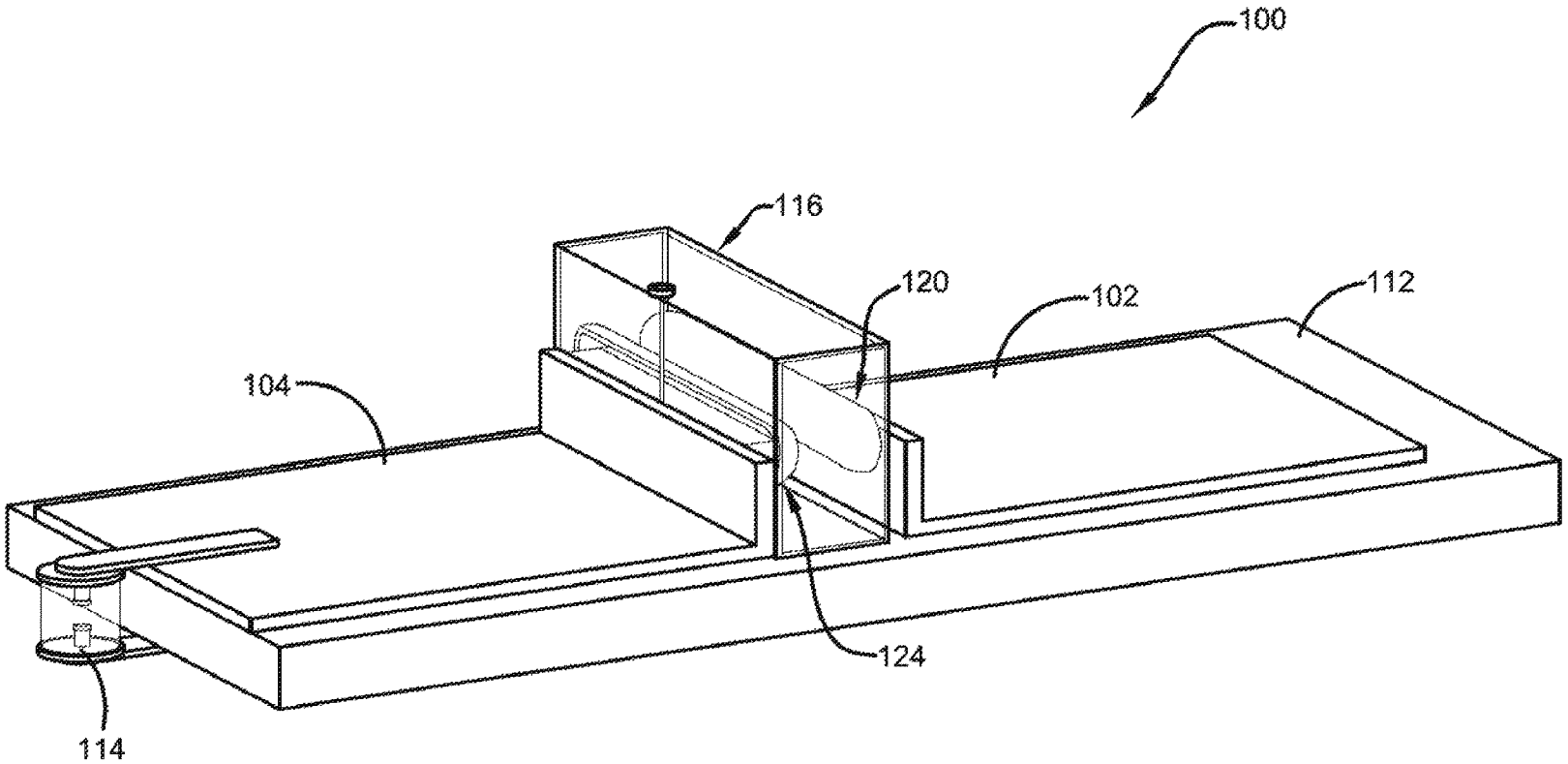
FIG. 4 is another isometric view of an exemplary short pulse neutron generator.

With reference now to FIG. 3, an isometric view of the short pulse neutron generator 100 is illustrated. As shown, the target surface 120 and the face 124 of the second electrode 122 can have a three-dimensional curved profile. For instance, the target surface 120 and the surface of the face 124 may have a three-dimensional elliptical shape. Moreover, the ion source 128 can be positioned in the cavity formed by the elliptical shape of the face 124 of the first electrode 122. Additionally, the switch 114 is shown as being a spark gap, that, when fired, creates a short circuit between the second conductive plate 104 and the third conductive plate 110. FIG. 4 illustrates another isometric view of the exemplary neutron generator 100.

Figure 5:
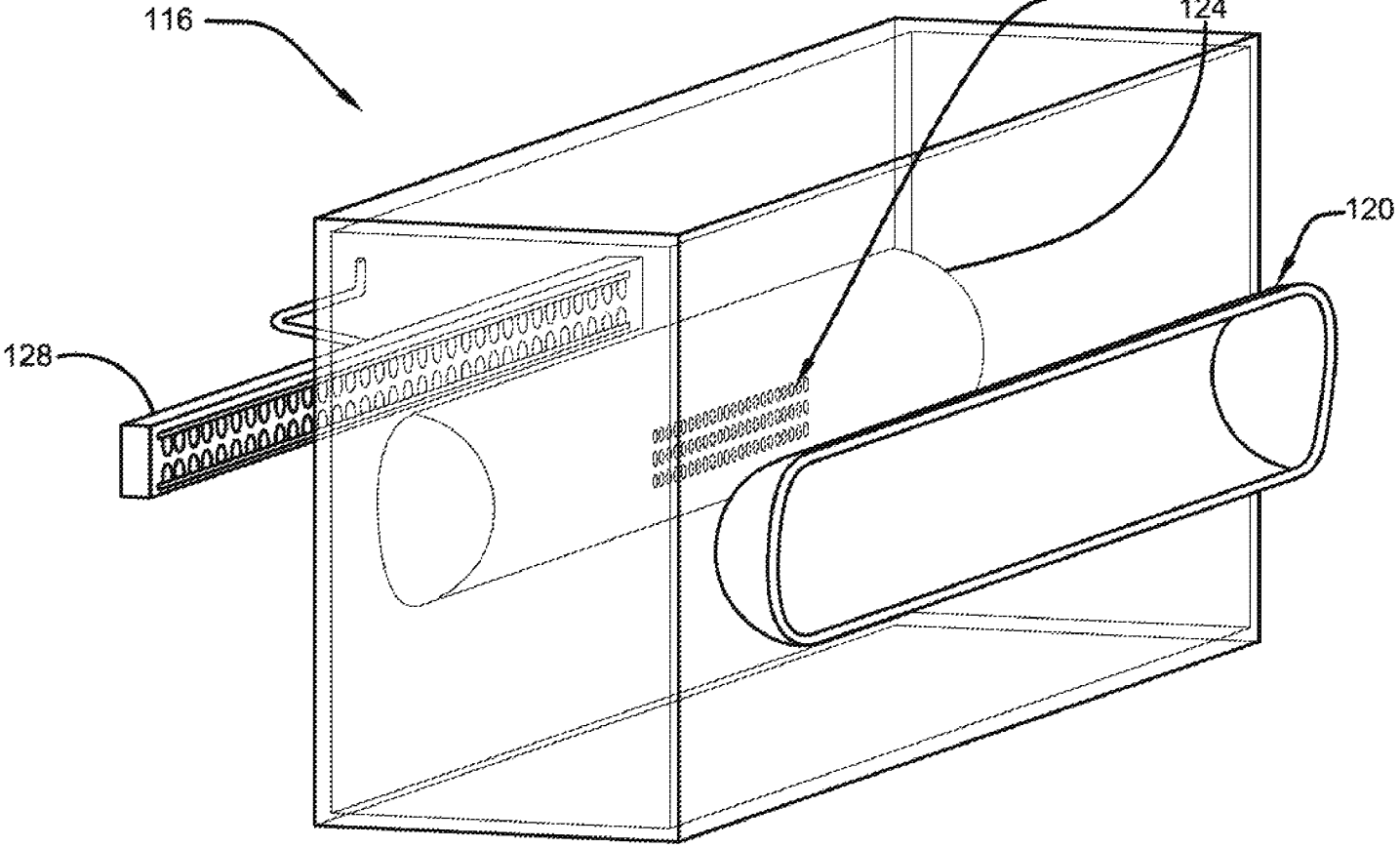
FIG. 5 is an isometric view of an exemplary vacuum chamber included in an exemplary short pulse neutron generator.

With reference now to FIG. 5, an isometric view of the vacuum chamber 116 is illustrated. The ion source 128 is shown as comprising a plurality of ion generators, which are arranged in matrix form to populate the cavity 126 formed by the curved surface of the face 124 of the second electrode 122 with ions. As shown, the face 124 includes a plurality of apertures 502 extending therethrough, such that ions proximate to the face 124 in the cavity 126 can escape the cavity 126 and be accelerated across the accelerating gap, thereby impacting the target surface 120 of the first electrode 118. When the ions impact the deuterium or tritium on the target surface 120, neutrons are generated and escape isotropically from the vacuum chamber 116.

Figure 6:
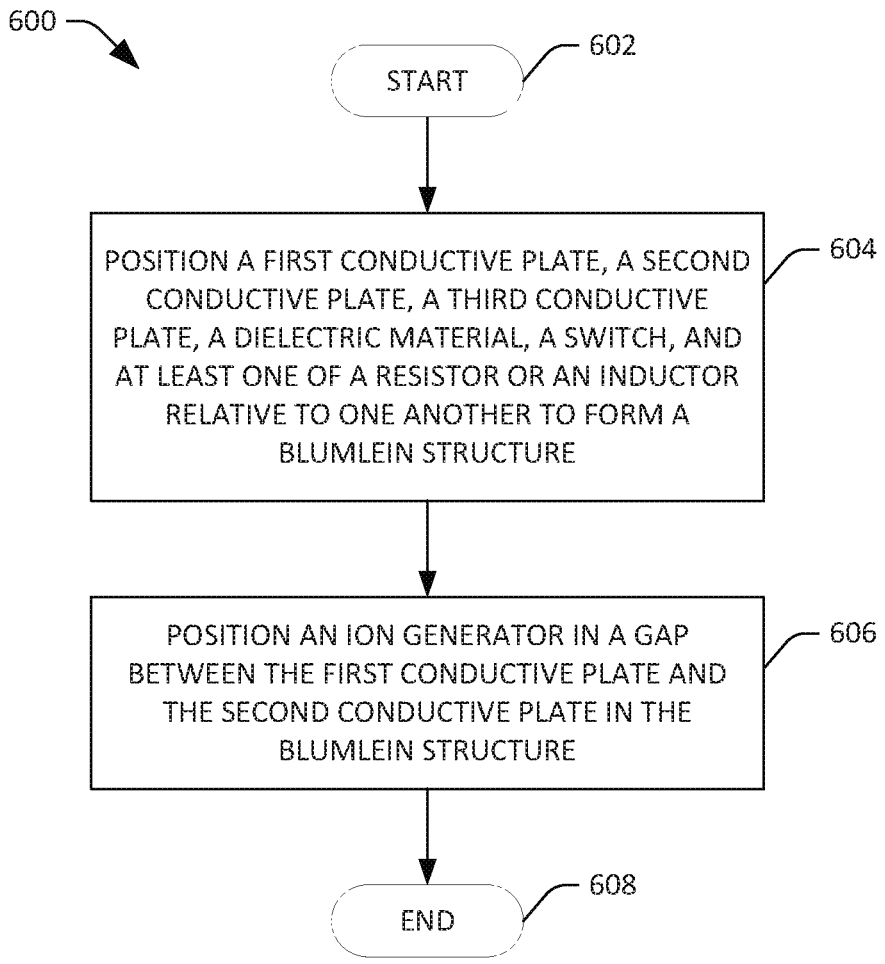
FIG. 6 is a flow diagram that illustrates an exemplary methodology for forming a short pulse neutron generator.
Figure 7:
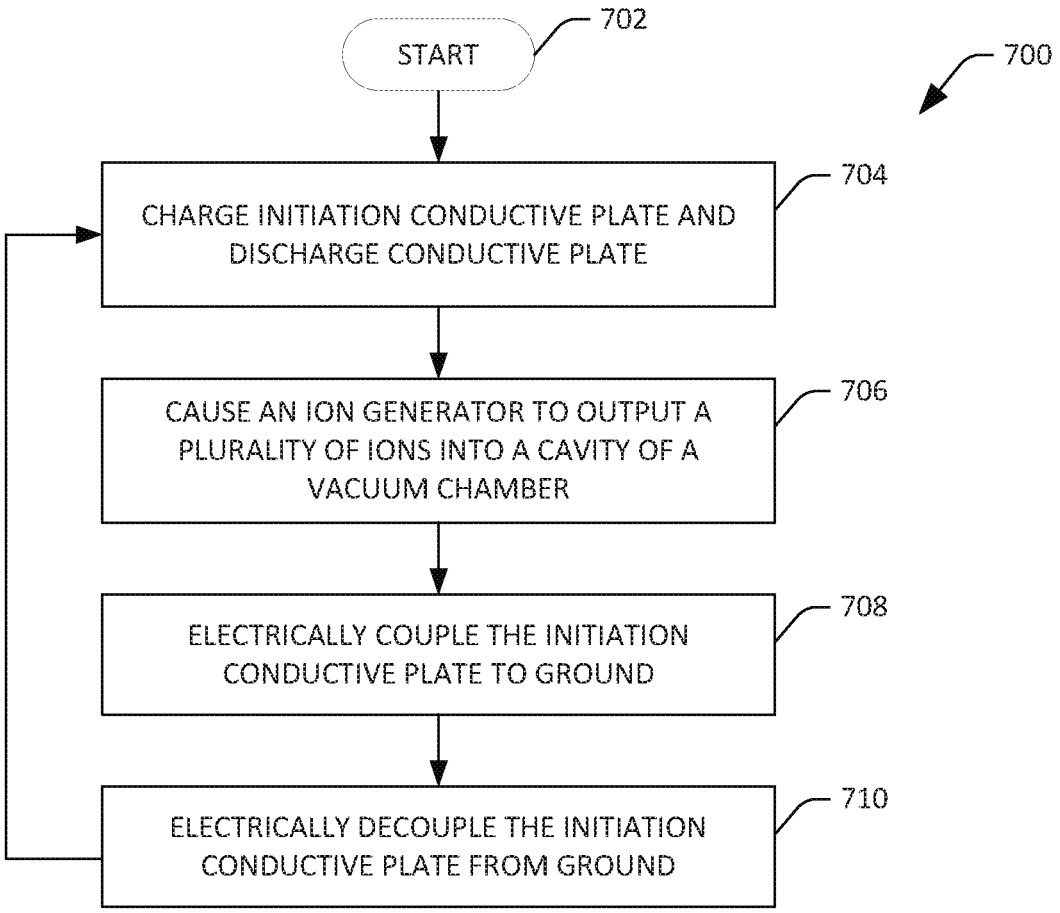
FIG. 7 is flow diagram that illustrates an exemplary methodology for operating a short pulse neutron generator.

FIGS. 6-7 illustrate exemplary methodologies relating to short pulse neutron generation. While the methodologies are shown and described as being a series of acts that are performed in a sequence, it is to be understood and appreciated that the methodologies are not limited by the order of the sequence. For example, some acts can occur in a different order than what is described herein. In addition, an act can occur concurrently with another act. Further, in some instances, not all acts may be required to implement a methodology described herein.

Turning now to FIG. 6, an exemplary methodology 600 for forming a short pulse neutron generator is illustrated. The methodology 600 starts at 602, and at 604 a first conductive plate, a second conductive plate, a third conductive plate, a dielectric material, a switch, and at least one of a resistor and/or inductor are positioned relative to one another to form a Blumlein structure. For example, as noted above, the first conductive plate can be positioned relative to the second conductive plate such that the first conductive plate and the second conductive plate are coplanar and separated by a gap. Further, the third conductive plate can be positioned in parallel with the first conductive plate and the second conductive plate, such that the third conductive plate is separated by a gap from the first conductive plate, and is further separated by a gap from the second conductive plate. The dielectric material can fill at least the gap between the first conductive plate and the third conductive plate. Moreover, forming the Blumlein structure can include positioning the at least one of the resistor or the inductor, such that the at least one of the resistor or the inductor is coupled to the first conductive plate and the second conductive plate.

At 606, an ion generator is positioned in the gap between the first conductive plate and the second conductive plate in the Blumlein structure. The methodology 600 completes at 608.

Now referring to FIG. 7, an exemplary methodology 700 for operating a short pulse neutron generator is illustrated. The methodology 700 starts at 702, and at 704 an initiation conductive plate and a discharge conductive plate are charged through utilization of a relatively high voltage source (e.g., 50 kV, 1 MV, 50 MV, etc.). At 706, an ion generator is caused to populate (pre-fill) a cavity with ions, the cavity positioned in a vacuum chamber, the vacuum chamber positioned in a gap of a Blumlein structure. At 708, the initiation conductive plate is electrically connected to ground, leaving the discharge conductive plate with an electric charge that attracts ions in the cavity. Such ions can be attracted to a target surface loaded with deuterium or tritium, thereby producing neutrons. At 710, the initiation conductive plate is disconnected from ground. The methodology 700 then returns to 704, where the methodology 700 can repeat indefinitely.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the details description or the claims, such term is intended to be inclusive in a manner similar to the term "comprising" as "comprising" is interpreted when employed as a transitional word in a claim.

What is claimed is:

1. A neutron generator comprising:

a Blumlein structure comprising:

a first conductive plate;

a second conductive plate separate from the first conductive plate by an accelerating gap, wherein the second conductive plate is coplanar with the first conductive plate;

a vacuum chamber positioned in the accelerating gap between the first conductive plate and the second conductive plate;

a first electrode having a first face, the first electrode coupled to the first conductive plate, wherein the first electrode comprises a target surface loaded with at least one of deuterium or tritium;

a second electrode having a second face, the second electrode coupled to the second conductive plate, wherein the second electrode comprises a target surface loaded with at least one of deuterium or tritium, the first electrode opposite the second electrode in the vacuum chamber and separated by the accelerating gap, wherein the first electrode face and the second electrode face each comprise a plurality of apertures, wherein the Blumlein structure is configured to accelerate ions in either direction of the first face and the second face in the accelerating gap; and an ion generator positioned between the first conductive plate and the second conductive plate, the ion generator positioned to output ions into the vacuum chamber.

2. The neutron generator of claim 1, the first electrode extending from the first conductive plate and comprising a third face, the third face forming a cavity, the third face positioned between the cavity and the second face of the second electrode, wherein a second ion generator is positioned relative to the cavity to pre-fill the cavity with ions.

3. The neutron generator of claim 1, wherein a width of the accelerating gap is between one tenth of a centimeter and two centimeters.

4. The neutron generator of claim 1, wherein at least one of the first face or the second face has a three-dimensional elliptical shape.

5. The neutron generator of claim 1, further comprising a first voltage source that is coupled to the first conductive plate and a second voltage source that drives the ion generator.

6. The neutron generator of claim 1, further comprising:

a third conductive plate; and a switch that is configured to electrically connect the second conductive plate to the third conductive plate and electrically disconnect the second conductive plate from the third conductive plate.

7. The neutron generator of claim 6, further comprising a dielectric material positioned between the first conductive plate and the third conductive plate.

8. The neutron generator of claim 2, the second electrode extending from the second conductive plate and comprising a fourth face, the fourth face forming a second cavity, the fourth face positioned between the second cavity and the first face of the first electrode, wherein a third ion generator is positioned relative to the second cavity to pre-fill the second cavity with ions.

* * * * *